US011056042B1

(12) United States Patent
Selan et al.

(10) Patent No.: US 11,056,042 B1
(45) Date of Patent: Jul. 6, 2021

(54) SYSTEMS AND METHODS TO REDUCE VISUAL ARTIFACTS IN DISPLAYS

(71) Applicant: VALVE CORPORATION, Bellevue, WA (US)

(72) Inventors: Jeremy Adam Selan, Kirkland, WA (US); Duane Martin Evans, Snohomish, WA (US)

(73) Assignee: Valve Corporation, Bellevue, WA (US)

( * ) Notice: Subject to any disclaimer, the term of this patent is extended or adjusted under 35 U.S.C. 154(b) by 0 days.

(21) Appl. No.: 16/828,241

(22) Filed: Mar. 24, 2020

Related U.S. Application Data

(62) Division of application No. 15/987,657, filed on May 23, 2018, now abandoned.

(60) Provisional application No. 62/515,041, filed on Jun. 5, 2017.

(51) Int. Cl.
*G09G 3/20* (2006.01)
*G09G 3/3225* (2016.01)
*G09G 3/36* (2006.01)

(52) U.S. Cl.
CPC ..... *G09G 3/2092* (2013.01); *G09G 3/3225* (2013.01); *G09G 3/3648* (2013.01); *G09G 2320/0266* (2013.01)

(58) Field of Classification Search
CPC .. G09G 3/2092; G09G 3/3225; G09G 3/3648; G09G 2320/0266; G09G 2310/08; G09G 2310/0205; G09G 2310/021; G09G 2310/0213
See application file for complete search history.

(56) References Cited

U.S. PATENT DOCUMENTS

2003/0043097 A1 3/2003 Shingai et al.
2015/0170561 A1* 6/2015 Ahn ..... G09G 3/2022 345/691
2018/0019432 A1* 1/2018 Kurasawa ..... G09G 3/3233

* cited by examiner

*Primary Examiner* — Dennis P Joseph
(74) *Attorney, Agent, or Firm* — Seed Intellectual Property Law Group LLP

(57) ABSTRACT

Systems and methods for providing display panels with reduced visual artifacts. A display system is provided that includes a pixel array having a plurality of pixels arranged in rows and columns. The display system receives an image stream that includes a plurality of sets of image data that each represent an image to be sequentially presented by the display system. The data for each frame or set of image data is loaded into the pixel array according to a loading sequence with reduces the visual artifacts perceived by a viewer of the display system. The loading sequence may include an inside-out loading sequence which gives preference to a central region of the pixel array, a speculative preloading sequence which first loads portions of the pixel array with speculative data, or various combinations thereof.

24 Claims, 9 Drawing Sheets

400

402 404

| LOAD SEQUENCE | | LOAD DATA |
|---|---|---|
| 1 | $r_0$ | $d_0$ |
| 1 | $r_1$ | $d_0$ |
| 2 | $r_2$ | $d_2$ |
| 2 | $r_3$ | $d_2$ |
| 3 | $r_4$ | $d_4$ |
| 3 | $r_5$ | $d_4$ |
| 4 | $r_6$ | $d_6$ |
| 4 | $r_7$ | $d_6$ |
| 5 | $r_8$ | $d_8$ |
| 5 | $r_9$ | $d_8$ |
| 6 | $r_{10}$ | $d_{10}$ |
| 6 | $r_{11}$ | $d_{10}$ |
| 7 | $r_{12}$ | $d_{12}$ |
| 7 | $r_{13}$ | $d_{12}$ |
| 8 | $r_{14}$ | $d_{14}$ |
| 8 | $r_{15}$ | $d_{14}$ |

FIG. 4A

500

502 504

| LOAD SEQUENCE | | LOAD DATA |
|---|---|---|
| 1 | $r_0$ | $d_0$ |
| 1 | $r_1$ | $d_0$ |
| 1 | $r_2$ | $d_0$ |
| 1 | $r_3$ | $d_0$ |
| 2 | $r_4$ | $d_4$ |
| 2 | $r_5$ | $d_4$ |
| 2 | $r_6$ | $d_4$ |
| 2 | $r_7$ | $d_4$ |
| 3 | $r_8$ | $d_8$ |
| 3 | $r_9$ | $d_8$ |
| 3 | $r_{10}$ | $d_8$ |
| 3 | $r_{11}$ | $d_8$ |
| 4 | $r_{12}$ | $d_{12}$ |
| 4 | $r_{13}$ | $d_{12}$ |
| 4 | $r_{14}$ | $d_{12}$ |
| 4 | $r_{15}$ | $d_{12}$ |

FIG. 5A

500

506 508

| LOAD SEQUENCE | | LOAD DATA |
|---|---|---|
| | $r_0$ | — |
| 1 | $r_1$ | $d_1$ |
| 2 | $r_2$ | $d_2$ |
| 3 | $r_3$ | $d_3$ |
| | $r_4$ | — |
| 4 | $r_5$ | $d_5$ |
| 5 | $r_6$ | $d_6$ |
| 6 | $r_7$ | $d_7$ |
| | $r_8$ | — |
| 7 | $r_9$ | $d_9$ |
| 8 | $r_{10}$ | $d_{10}$ |
| 9 | $r_{11}$ | $d_{11}$ |
| | $r_{12}$ | — |
| 10 | $r_{13}$ | $d_{13}$ |
| 11 | $r_{14}$ | $d_{14}$ |
| 12 | $r_{15}$ | $d_{15}$ |

FIG. 5B

600

| 602 LOAD SEQUENCE | | 604 LOAD DATA |
|---|---|---|
| 9 | $r_0$ | $d_0$ |
| 9 | $r_1$ | $d_0$ |
| 7 | $r_2$ | $d_2$ |
| 7 | $r_3$ | $d_2$ |
| 5 | $r_4$ | $d_4$ |
| 5 | $r_5$ | $d_4$ |
| 3 | $r_6$ | $d_6$ |
| 3 | $r_7$ | $d_6$ |
| 1 | $r_8$ | $d_8$ |
| 1 | $r_9$ | $d_8$ |
| 2 | $r_{10}$ | $d_{10}$ |
| 2 | $r_{11}$ | $d_{10}$ |
| 4 | $r_{12}$ | $d_{12}$ |
| 4 | $r_{13}$ | $d_{12}$ |
| 6 | $r_{14}$ | $d_{14}$ |
| 6 | $r_{15}$ | $d_{14}$ |
| 8 | $r_{16}$ | $d_{16}$ |
| 8 | $r_{17}$ | $d_{16}$ |

FIG. 6A

SYSTEMS AND METHODS TO REDUCE VISUAL ARTIFACTS IN DISPLAYS

BACKGROUND

Technical Field

The present disclosure generally relates to displays, and more particularly, to reducing visual artifacts in displays.

Description of the Related Art

Demand for displays with heightened performance is increasing, including with the growth of smart phones and high-definition televisions, as well as other electronic devices. The growing popularity of virtual reality and augmented reality systems, particularly those using head mounted displays, has further increased such demand. Virtual reality systems typically envelop a wearer's eyes completely and substitute a "virtual" reality for the actual view (or actual reality) in front of the wearer, while augmented reality systems typically provide a semi-transparent or transparent overlay of one or more screens in front of a wearer's eyes such that actual view is augmented with additional information. In many virtual reality and augmented reality systems, the movement of a wearer of such a head mounted display may be tracked in various manners, such as via sensors in the head mounted display and/or external to it, in order to enable the images being shown to reflect user movements.

However, such head mounted displays, with reduced distance between a viewer's eye and the display and often with a fully obscured field of view, have increased the performance requirements of displays in ways that traditional displays cannot satisfy, let alone to do so at cost-effective levels. Accordingly, needs exist for improved display panels, and for improved techniques for manufacturing and using display panels.

BRIEF SUMMARY

A method of operating a display system, the display system including a pixel array that includes plurality of pixels arranged in rows and columns, may be summarized as including receiving, by at least one processor of the display system, an image stream comprising a plurality of sets of image data, each set of image data representative of an image to be sequentially presented by the pixel array of the display system, and each set of image data comprises a plurality of pixel values that each correspond to one of the plurality of pixels in the pixel array; and causing, by the at least one processor, each of the plurality of sets of image data to be sequentially loaded to the pixel array such that the images are sequentially presented by the pixel array, wherein causing each set of image data that is representative of an image to be loaded to the pixel array comprises, for each set of image data: loading a centrally located block of one or more rows of the pixel array with image data from the set of image data, the centrally located block of one or more rows is at least substantially centrally located between a top row and a bottom row of the pixel array; and loading the remaining rows of the pixel array with image data from the set of image data according to a loading sequence that begins at a row of the pixel array proximate the centrally located block of one or more rows and proceeds upward and downward therefrom toward the top row and the bottom row, respectively, of the pixel array.

Loading the remaining rows of the pixel array may include, alternatingly: loading a number of rows that are positioned proximate to and one of above or below one or more rows that have been previously loaded with image data from the set of image data; and loading the number of rows that are positioned proximate to and the other of above or below one or more rows that have been previously loaded with image data from the set of image data. Loading a number of rows that may be positioned proximate to and one of above or below one or more rows may include loading a single row that is positioned proximate to and one of above or below one or more rows that have previously been loaded with image data from the set of image data, and loading the number of rows that are positioned proximate to and the other of above or below one or more rows comprises loading a single row that is positioned proximate to and the other of above or below one or more rows that have previously been loaded with image data from the set of image data. Loading a number of rows that may be positioned proximate to and one of above or below one or more rows may include loading a plurality of rows that are positioned proximate to and one of above or below one or more rows that have previously been loaded with image data from the set of image data, and loading the number of rows that are positioned proximate to and the other of above or below one or more rows comprises loading a plurality of rows that are positioned proximate to and the other of above or below one or more rows that have previously been loaded with image data from the set of image data. Loading a number of rows that may be positioned proximate to and one of above or below one or more rows may include loading a variable number of rows that are positioned proximate to and one of above or below one or more rows that have previously been loaded with image data from the set of image data, and loading the number of rows that are positioned proximate to and the other of above or below one or more rows comprises loading a variable number of rows that are positioned proximate to and the other of above or below one or more rows that have previously been loaded with image data from the set of image data. Loading the centrally located block of one or more rows may include loading the centrally located block of one or more rows of the pixel array with image data from the set of image data, the centrally located block of one or more rows positioned at a location of the pixel array that corresponds to an expected central region of a visual field of a viewer of the display system.

A display system may be summarized as including a pixel array that includes plurality of pixels arranged in rows and columns; at least one pixel driver subsystem operatively coupled to the pixel array; and at least one processor operatively coupled to the at least one pixel driver subsystem, in operation the at least one processor: receives an image stream comprising a plurality of sets of image data, each set of image data representative of an image to be sequentially presented by the pixel array of the display system, and each set of image data comprises a plurality of pixel values that each correspond to one of the plurality of pixels in the pixel array; and causes the at least one pixel driver subsystem to sequentially load each of the plurality of sets of image data to the pixel array such that the images are sequentially presented by the pixel array, wherein, for each set of image data, the at least one processor causes the at least one pixel driver subsystem to: load a centrally located block of one or more rows of the pixel array with image data from the set of image data, the centrally located block of one or more rows is at least substantially centrally located between a top row and a bottom row of the pixel array; and load the remaining rows of the pixel array with image data from the set of image data according to a loading sequence that begins at a row of the pixel array proximate the centrally located block of one or more rows and proceeds upward and downward from the centrally located block of one or more rows toward the top row and the bottom row, respectively, of the pixel array. For each set of image data, the at least one processor may cause the at least one pixel driver subsystem to: alternatingly, load a number of rows that are positioned proximate to and one of above or below one or more rows that have been previously loaded with image data from the set of image data; and load the number of rows that are positioned proximate to and the other of above or below one or more rows that have been loaded with image data from the set of image data. The number of rows may include a single row. The number of rows may include a plurality of rows. The number of rows may include a variable number of rows. The centrally located block of one or more rows may be positioned at a location of the pixel array that corresponds to an expected central region of a visual field of a viewer of the display system.

A method of operating a display system, the display system including a pixel array that includes plurality of pixels arranged in rows and columns, may be summarized as including receiving, by at least one processor of the display system, an image stream comprising a plurality of sets of image data, each set of image data representative of an image to be sequentially presented by the pixel array of the display system, and each set of image data comprises a plurality of pixel values that each correspond to one of the plurality of pixels in the pixel array; and causing, by the at least one processor, each of the plurality of sets of image data to be sequentially loaded to the pixel array such that the images are sequentially presented by the pixel array, wherein causing each set of image data that is representative of an image to be loaded to the pixel array comprises, for each set of image data: sequentially loading each of a plurality of direct load rows of the pixel array with final image data for each of the respective direct load rows, each of the direct load rows associated with one or more speculative preload rows positioned proximate the direct load row, and simultaneously with the loading of each direct load row, loading the one or more speculative preload rows associated with the direct load row with speculative preload image data that is based on the final image data for the associated direct load row; and subsequent to sequentially loading each of the plurality of direct load rows, sequentially reloading each of the speculative preload rows of the pixel array with final image data for each of the respective speculative preload rows. The direct load rows may include one of the even rows and the odd rows of the pixel array, and the speculative preload rows may include the other of the even rows and the odd rows of the pixel array. Each direct load row may be associated with a plurality of speculative preload rows.

Loading the one or more speculative preload rows associated with the direct load row with speculative preload image data that may be based on the final image data for the direct load row may include loading the one or more speculative preload rows associated with the direct load row with speculative preload image data that is a duplicate of the final image data for the associated direct load row. Loading the one or more speculative preload rows associated with the direct load row with speculative preload image data that may be based on the final image data for the direct load row may include loading the one or more speculative preload rows associated with the direct load row with speculative preload image data that is at least one of extrapolated or interpolated from the final image data for a plurality of direct load rows. Sequentially loading each of a plurality of direct load rows may include sequentially loading each of a plurality of direct load rows beginning at a centrally located direct load block of one or more rows positioned proximate a central region of the pixel array and proceeding upward and downward toward the top row and the bottom row, respectively, of the pixel array. Sequentially loading each of the speculative preload rows may include sequentially loading each of the speculative preload rows beginning at a speculative preload row positioned proximate the central region of the pixel array and proceeding upward and downward toward the top row and the bottom row, respectively, of the pixel array.

A display system may be summarized as including a pixel array that includes plurality of pixels arranged in rows and columns; at least one pixel driver subsystem operatively coupled to the pixel array; and at least one processor operatively coupled to the at least one pixel driver subsystem, in operation the at least one processor: receives an image stream comprising a plurality of sets of image data, each set of image data representative of an image to be sequentially presented by the pixel array of the display system, and each set of image data comprises a plurality of pixel values that each correspond to one of the plurality of pixels in the pixel array; and causes the at least one pixel driver subsystem to sequentially load each of the plurality of sets of image data to the pixel array such that the images are sequentially presented by the pixel array, wherein, for each set of image data, the at least one processor causes the at least one pixel driver subsystem to: sequentially load each of a plurality of direct load rows of the pixel array with final image data for each of the respective direct load rows, each of the direct load rows associated with one or more speculative preload rows positioned proximate the direct load row, and simultaneously with the loading of each direct load row, loading the one or more speculative preload rows associated with the direct load row with speculative preload image data that is based on the final image data for the associated direct load row; and subsequent to the sequential load each of the plurality of direct load rows, sequentially reload each of the speculative preload rows of the pixel array with final image data for each of the respective speculative preload rows. The direct load rows may include one of the even rows and the odd rows of the pixel array, and the speculative preload rows may include the other of the even rows and the odd rows of the pixel array. Each direct load row may be associated with a plurality of speculative preload rows.

The at least one processor may cause the at least one pixel driver subsystem to load the one or more speculative preload rows associated with the direct load row with speculative preload image data that is a duplicate of the final image data for the associated direct load row. The at least one processor may cause the at least one pixel driver subsystem to load the one or more speculative preload rows associated with the direct load row with speculative preload image data that is at least one of extrapolated or interpolated from the final image data for a plurality of direct load rows. The at least one processor may cause the at least one pixel driver subsystem to load each of a plurality of direct load rows beginning at a centrally located direct load block of one or more rows positioned proximate a central region of the pixel array and proceeding upward and downward toward the top row and the bottom row, respectively, of the pixel array. The at least one processor may cause the at least one pixel driver subsystem to sequentially load each of the speculative preload rows beginning at a speculative preload row positioned proximate the central region of the pixel array and proceeding upward and downward toward the top row and the bottom row, respectively, of the pixel array.

A method of operating a video source system that in operation may provide image data to a display system including a pixel array that includes plurality of pixels arranged in rows and columns, may be summarized as including sending, by at least one processor, an image stream comprising a plurality of sets of image data to the display system, each set of image data representative of an image to be sequentially presented by the pixel array of the display system, and each set of image data comprises a plurality of pixel values that each correspond to one of the plurality of pixels in the pixel array, wherein sending the image stream comprises, for each set of image data: sending image data from the set of image data for a centrally located block of one or more rows of the pixel array, the centrally located block of one or more rows is at least substantially centrally located between a top row and a bottom row of the pixel array; and sending image data from the set of image data for the remaining rows of the pixel array according to a sending sequence that begins at a row of the pixel array proximate the centrally located block of one or more rows and proceeds upward and downward therefrom toward the top row and the bottom row, respectively, of the pixel array. Sending image data for the remaining rows of the pixel array may include, alternatingly: sending image data for a number of rows that are positioned proximate to and one of above or below one or more rows for which image data has previously been sent; and sending image data for the number of rows that are positioned proximate to and the other of above or below one or more rows for which image data has been previously been sent.

A video source system may be summarized as including at least one nontransitory processor-readable storage medium which stores at least one of instructions or data; at least one processor operatively coupled to the at least one nontransitory processor-readable storage medium and a display system, the display system comprising a pixel array that includes a plurality of pixels arranged in rows and columns, in operation the at least one processor: sends an image stream comprising a plurality of sets of image data to the display system, each set of image data representative of an image to be sequentially presented by the pixel array of the display system, and each set of image data comprises a plurality of pixel values that each correspond to one of the plurality of pixels in the pixel array, wherein for each set of image data, in operation the processor: sends image data from the set of image data for a centrally located block of one or more rows of the pixel array, the centrally located block of one or more rows is at least substantially centrally located between a top row and a bottom row of the pixel array; and sends image data from the set of image data for the remaining rows of the pixel array according to a sending sequence that begins at a row of the pixel array proximate the centrally located block of one or more rows and proceeds upward and downward therefrom toward the top row and the bottom row, respectively, of the pixel array.

A method of operating a video source system that in operation may provide image data to a display system, the display system including a pixel array that includes plurality of pixels arranged in rows and columns, may be summarized as including sending, by at least one processor, an image stream comprising a plurality of sets of image data to the display system, each set of image data representative of an image to be sequentially presented by the pixel array of the display system, and each set of image data comprises a plurality of pixel values that each correspond to one of the plurality of pixels in the pixel array wherein sending the image stream comprises, for each set of image data: sequentially sending final image data for each of a plurality of direct load rows of the pixel array to the display system for loading by the display system, each of the direct load rows associated with one or more speculative preload rows positioned proximate the direct load row, wherein simultaneously with the loading of each direct load row by the display system, the display system loads the one or more speculative preload rows associated with the direct load row with speculative preload image data that is based on the final image data for the associated direct load row; and subsequent to sequentially sending final image data for each of the plurality of direct load rows, sequentially sending final image data for each of the speculative preload rows of the pixel array to the display system for loading by the display system.

A video source system may be summarized as including at least one nontransitory processor-readable storage medium which stores at least one of instructions or data; at least one processor operatively coupled to the at least one nontransitory processor-readable storage medium and a display system, the display system comprising a pixel array that includes a plurality of pixels arranged in rows and columns, in operation the at least one processor: sends an image stream comprising a plurality of sets of image data to the display system, each set of image data representative of an image to be sequentially presented by the pixel array of the display system, and each set of image data comprises a plurality of pixel values that each correspond to one of the plurality of pixels in the pixel array, wherein for each set of image data, in operation the processor: sequentially sends final image data for each of a plurality of direct load rows of the pixel array to the display system for loading by the display system, each of the direct load rows associated with one or more speculative preload rows positioned proximate the direct load row, wherein simultaneously with the loading of each direct load row by the display system, the display system loads the one or more speculative preload rows associated with the direct load row with speculative preload image data that is based on the final image data for the associated direct load row; and subsequent to final image data for each of the plurality of direct load rows being sequentially sent, sequentially sends final image data for each of the speculative preload rows of the pixel array to the display system for loading by the display system.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

FIG. 4A is a diagram of a pixel array of a display system showing a first phase of a speculative preloading sequence for loading rows of pixels of the pixel array with image data, according to one illustrated implementation.

FIG. 5A is a diagram of a pixel array of a display system showing first phase of a speculative preloading sequence for loading rows of pixels of the pixel array with image data, wherein the speculative preloading sequence operates on blocks of rows rather than individual rows, according to one illustrated implementation.

FIG. 5B is a diagram of the pixel array of FIG. 5B, showing a second phase of the speculative preloading sequence, according to one illustrated implementation.

FIG. 6A is a diagram of a pixel array of a display system showing a first phase of an inside-out speculative preloading sequence for loading rows of pixels of the pixel array with image data, according to one illustrated implementation.

DETAILED DESCRIPTION

Figure 1:
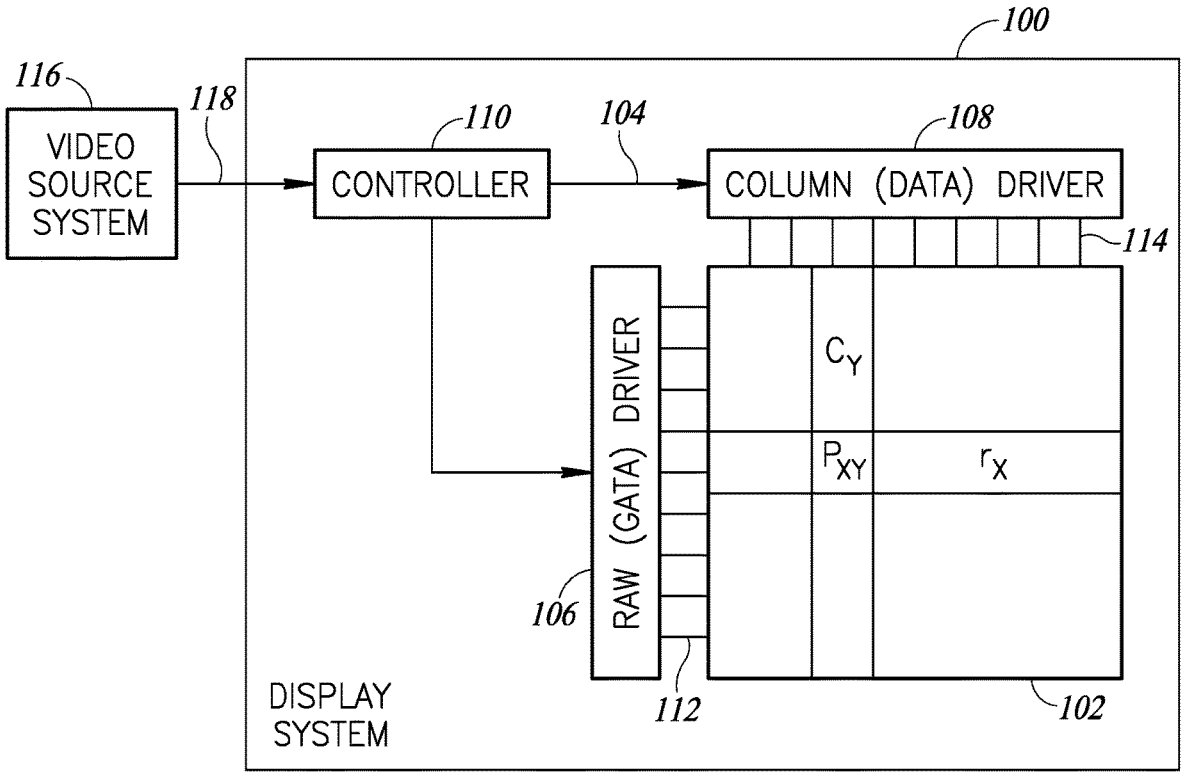
FIG. 1 is a schematic block diagram of a display system, according to one illustrated implementation.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with computer systems, server computers, and/or communications networks have not been shown or described in detail to avoid unnecessarily obscuring descriptions of the implementations.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the implementations.

Display panels or "displays" are included in a range of devices, including entertainment devices (e.g., head mounted displays (HMDs)), consumer electronics, personal computers, mobile devices, medical equipment, transportation equipment, commercial equipment, etc. Flat panel displays may utilize various types of technologies, including liquid crystal display (LCD) technologies and/or light emitting diode (LED) technologies, for example.

Generally, LCD screens utilize a thin layer of liquid crystal that is sandwiched between two electrically conducting plates. The top plate that faces the viewer may have transparent electrodes deposited on it, and the back plate may be illuminated by one or more light sources so that the viewer can see the images on the screen. By applying controlled electrical signals across the plates, various segments or pixels of the liquid crystal can be activated, causing changes in their light diffusing or polarizing properties. An image is produced by passing light through selected segments of the liquid crystal to the viewer. LCD screens may be backlit with a number of different light sources (e.g., a plurality of LEDs).

LED screens utilize an array of LEDs as pixels for a video display. A common type of LED screen is an organic light-emitting diode (OLED) display. An OLED is an LED in which the emissive electroluminescent layer is a film of organic compound which emits light in response to an electric current. This layer of organic semiconductor is situated between two electrodes. OLEDs are used to create digital displays in devices such as television screens, computer monitors, mobile phones, handheld game consoles, etc.

To control each of the pixel elements ("pixels"), display technologies typically utilize an active-matrix technology addressing scheme. In this method of controlling individual pixels, each pixel is attached to a switch device (e.g., transistor) and capacitor actively maintaining the pixel state while other pixels are being addressed. Given a display that consists of an m×n matrix of pixels, the number of connectors needed to address the display is m+n. Each pixel is attached to the switch device, which actively maintains the pixel state while other pixels are being addressed, also preventing crosstalk from inadvertently changing the state of an unaddressed pixel. The most common switching devices use thin-film transistors (TFTs), which is a field-effect transistor (FET) based on non-crystalline thin-film silicon (a-Si), polycrystalline silicon (poly-Si), cadmium selenide, zinc oxide, hafnium oxide, organic field-effect transistors (OTFTs), or other suitable semiconductor material. Another variant is to utilize diodes or resistors.

Pixels of the various display technologies require a time interval after new data is loaded to fully respond to the new value. Example parameters include row charge times for OLED screens and response times for LCD displays. Images are typically transmitted by a video source (e.g., graphics processor) and loaded into a display in a sequential (progressive) row ordering that proceeds from bottom-to-top of the display or from top-to-bottom of the display (i.e., load row 0, load row 1, load row 2, . . . , load row N). Once the data for a frame is loaded, the display may be illuminated. For displays illuminated with a low duty cycle, this results in a variable settling time across the pixels of the display. That is, rows at the top (or bottom) of the display have a longer time to settle prior to illumination compared to rows toward the bottom (or top) of the display. Such variability in settling time causes undesirable visual artifacts, particularly toward the portion of the display where the pixels have the shortest time to settle.

One or more implementations of the present disclosure provide systems and methods for reducing the visual significance of unsettled data in displays. FIG. 1 shows an example display system 100 in which the functionality disclosed herein may be implemented. The display system 100 includes a pixel array 102 in which a plurality of pixels p are arranged in rows r and columns c. Although only one row, labeled $r_x$, one column, labeled $c_y$, and one pixel labeled $p_{xy}$, are shown, in practice the pixel array 102 may be any desirable M×N array, where M is the number of rows and N is the number of columns in the pixel array. The display system 100 may be an LCD system or an OLED system, for example. In implementations wherein the display system 100 is a color display, the pixels p may comprise sub-pixels that each produce a different color (e.g., red, green, blue).

Adjacent the pixel array 102 of the display system 100 is a peripheral area 104 which includes circuitry for driving the individual pixels of the pixel array 102. In particular, the circuitry comprises a row driver circuit 106, also referred to as a gate or scan driver circuit, and a column driver circuit 108, also referred to as a data driver circuit. The row driver circuit 106 and column driver circuit 108 may be collectively referred to herein as a "pixel driver subsystem." Each of the driver circuits 106 and 108 may be formed from one or more integrated circuits, for example.

The display system 100 also includes a controller 110 that controls the row driver circuit 106 and the column driver circuit 108. The row driver circuit 106 includes a plurality of row select lines 112, one for each of the rows r of pixels (or sub-pixels) in the pixel array 102. Each of row select lines 112 is electrically coupled to a plurality scan electrodes for the pixels in the corresponding row of the pixel array 102. The column driver circuit 108 includes a plurality of data lines 114, one for each of the columns c of pixels (or sub-pixels) in the pixel array 102. Each of the data lines 114 is electrically coupled to data electrodes for the pixels in the corresponding column of the pixel array 102.

The row driver circuit 106, under control of the controller 110, selectively enables one or more rows of the pixel array 102 at a time via the row select lines 112. The column driver circuit 108, under control of the controller 110, outputs data (e.g., voltage levels) on the data lines 114 for each of the columns of pixels in the pixel array 102. Thus, the intensity of light transmitted by each pixel is determined by a drive voltage applied by the column driver circuit 108 to a pixel's data electrode via a data line 114 when the pixel's scan electrode is pulsed high by the row driver circuit 106 via a row select line 112. As discussed below, in at least some implementations the driver circuits 106 and 108 and/or the controller 110 may be configured to simultaneously load multiple rows with the same data or similar data.

The controller 110 is operatively coupled to a video source system or host system 116, which feeds an image stream 118 (e.g., processed video data) to the controller 110 for display on the display system 100. The video source system 116 may be any video output source system that utilizes the display system, such as a flat panel television, laptop, tablet computer, mobile phone, head mounted display, wearable computer, etc. The video source system 116 may be a component (e.g., graphics controller) of a larger system. The controller 110 receives the image stream 118 and converts it to the appropriate voltage programming information to be provided to the pixels in the pixel array 102 to sequentially display images present in the image stream.

The controller 110 may include a level shifter, timing, and analog functions generators, for example. Generally, the controller 110 may generate timing and data signals for biasing the row and column driver circuits 106 and 108, by taking as input from the video source system 116 one or more of the image stream signals (e.g., digital signals), synchronization information, timing information, etc.

The controller 110 and/or the video output system 116 may be separate components or their functionality may be combined in any number of ways. The controller 110 and/or the video output system 116 may include one or more processors, memory, I/O interfaces, communications systems, etc. The one or more processors may include, for example, one or more central processing units (CPUs), microprocessors, digital signal processors (DSPs), application-specific integrated circuits (ASICs), field programmable gate arrays (FPGAs), graphics processing units (GPUs), microcontrollers, other programmable circuits, combinations of the above, etc. The controller 110 and/or the video output system 116 may include one or more memory components, such as one or more solid state memory components, which provide volatile or nonvolatile storage of computer-readable instructions, data, program modules, etc.

As noted above, with conventional displays (e.g., OLED screens, LCD screens), for each set of image data that represents an image (frame), the image data is transmitted and loaded into the display in a sequential (progressive) row ordering that begins at the top row (e.g., row 0) of the pixel array and progresses downward row-by-row until the bottom row (e.g., row N) of the pixel array is loaded. Alternatively, the image data may be transmitted and loaded from bottom-to-top. Since each pixel requires a finite time interval after data is loaded to fully respond to the new value (e.g., intensity value), the available response time for pixels in the middle and bottom (or top if loaded bottom-to-top) of the display is shorter than the response time for the pixels at the top (or bottom if loaded bottom-to-top) of the display, causing undesirable visual artifacts (e.g., residual intensity values from the prior frame) at the portions of the display with less available response time.

FIGS. 2-6B discussed below show various example implementations of data loading sequences which may be used to load pixel arrays of a display system to reduce or minimize such visual artifacts. The pixel arrays of FIGS. 2-6B may include some or all of the components of the display system 100 discussed above.

Figure 2:
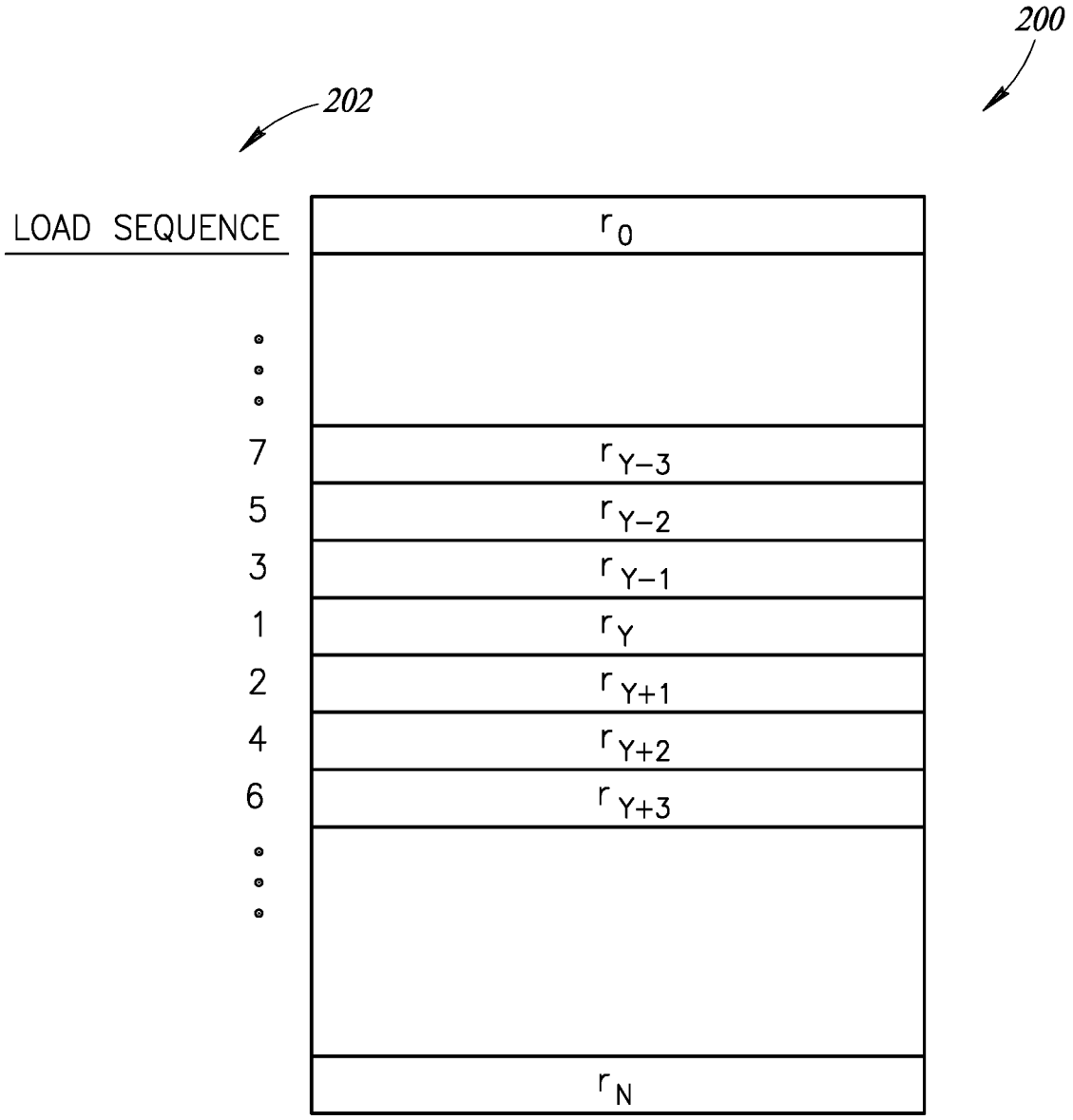
FIG. 2 is a diagram of a pixel array of a display system showing an inside-out loading sequence for loading rows of pixels of the pixel array with image data, according to one illustrated implementation.

FIG. 2 is a diagram of a pixel array 200 of a display system, such as the display system 100 of FIG. 1, showing an inside-out loading sequence for loading rows of pixels of the pixel array with a frame of image data. In operation, the inside-out loading sequence is repeated for each frame of a received image stream to provide moving images (e.g., video) on the display. The pixel array 200 includes a number of rows, labeled r0-N. To the left of the pixel array 102 there is a table 202 which indicates the load sequence or order for loading each of the rows r0-N of the pixel array.

In this implementation, for each frame of image data, the data is transmitted (e.g., by a video source system) and loaded (e.g., by a controller and driver circuits) into the rows of the pixel array 200 in alternating order ("inside-out"), giving preference to a centrally located block of one or more rows (e.g., one row, two rows, 4 rows, 10 rows) positioned at a central portion of the display, which corresponds to an expected central region of a visual field of a viewer of the display system. This feature pushes the rows which have the least time to settle to the peripheries of the display, where the viewer's gaze is less likely to be focused. As discussed above, the least settled rows may have relatively more undesirable visual artifacts compared to rows which have relatively more time to settle. Thus, utilizing the inside-out loading sequence, the portion of the pixel array 200 which corresponds to the central region of the visual field of the view contains the most settled rows, which are more visually pleasing to the viewer.

In the implementation shown in FIG. 2, image data is initially transmitted and loaded for a centrally located row of the pixel array 102, designated $r_y$ in FIG. 2. In other implementations, the centrally located block of a single row $r_y$ may comprise a block of more than one row (e.g., two rows, four rows, eight rows). The centrally located row $r_y$ need not be the exact center row of the pixel array 200, but may be at least substantially centrally located between a top row $r_0$ and a bottom row $r_1$ of the pixel array. Then, the remaining rows of the pixel array 200 may be loaded with the image data for a frame according to a loading sequence that begins at a row of the pixel array proximate (e.g., adjacent) the centrally located row $r_y$ (e.g., row $r_{y+1}$ or row $r_{y-1}$) and proceeds alternatingly upward and downward away from the centrally located row $r_y$ toward the top row $r_0$ and the bottom row $r_N$, respectively, of the pixel array 200. In the example of FIG. 2, the rows are loaded according to the following sequence: $r_y$, $r_{y+1}$, $r_{y-1}$, $r_{y+2}$, $r_{y-2}$, $r_{y+3}$, $r_{y-3}$, etc., until all of the rows have been loaded with the image data for the frame. In other implementations, the rows may be loaded according to the following sequence: $r_y$, $r_{y-1}$, $r_{y+1}$, $r_{y-2}$, $r_{y+2}$, $r_{y-3}$, $r_{y+3}$, etc., until all of the rows have been loaded with the image data for the frame.

Generally, once the centrally located row $r_y$ has been loaded, the remaining rows may be loaded by alternatingly (1) loading a number of rows that are positioned proximate to and one of above or below one or more rows that have been previously loaded with image data from the set of image data, and (2) loading the number of rows that are positioned proximate to and the other of above or below one or more rows that have been loaded with image data from the set of image data, until all of the rows have been loaded.

Figure 3:
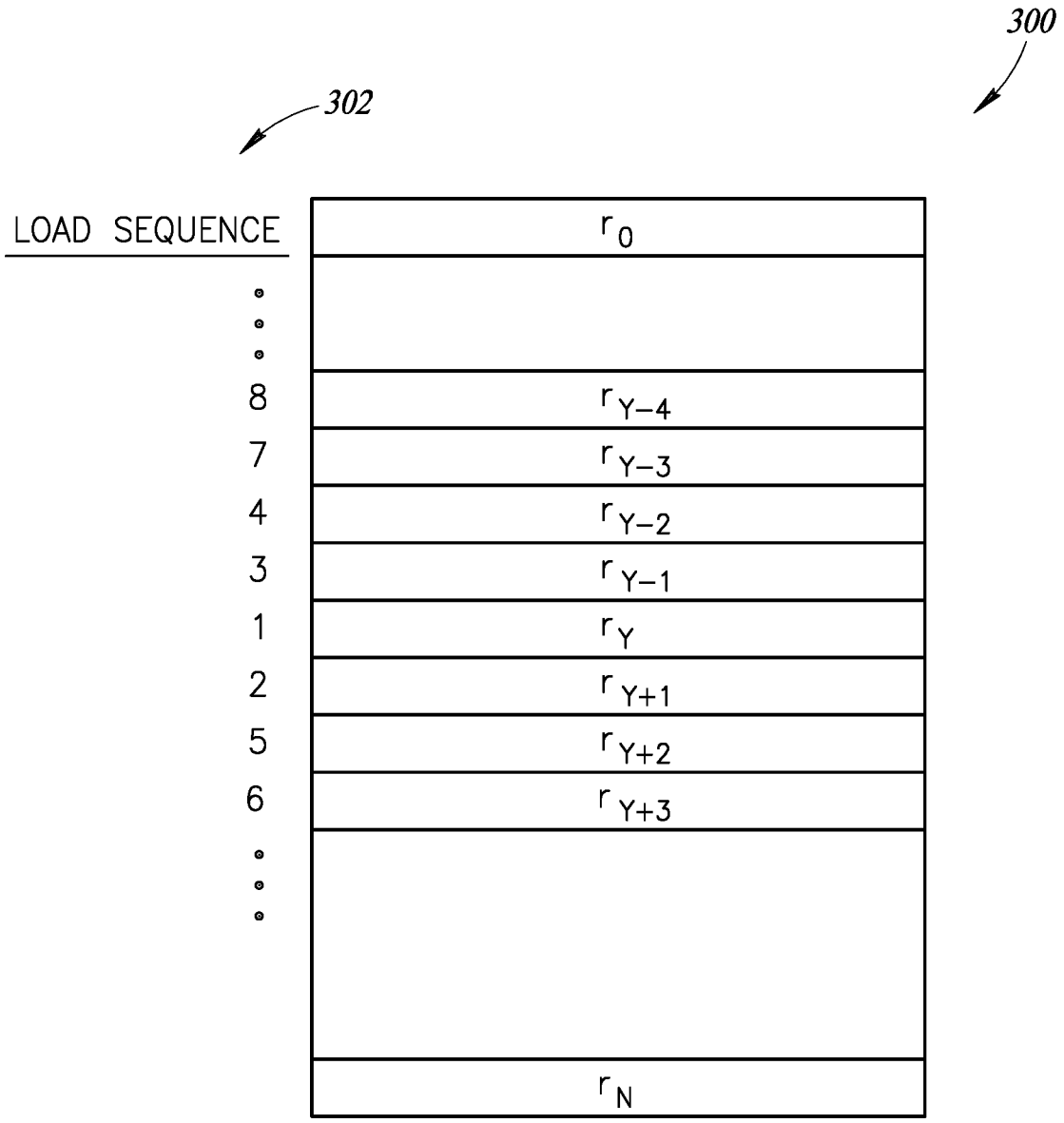
FIG. 3 is a diagram of a pixel array of a display system showing an inside-out loading sequence for loading rows of pixels of the pixel array with image data, wherein the loading sequence operates on blocks of rows rather than individual rows, according to one illustrated implementation.

Instead of alternatingly loading one row above or below the centrally located row $r_y$ during each alternating iteration, a block of multiple rows may be loaded above or below the centrally located row each alternating iteration. FIG. 3 shows an example load sequence for a pixel array 300 which loads a block of two rows during each iteration above or below the centrally located row $r_y$. The loading sequence is shown in a table 302 positioned to the left of the pixel array 300. In this example, the rows $r_{0\text{-}N}$ of the pixel array 300 are loaded according to the following sequence: $r_y$, $r_{y-1}$, $r_{y-2}$, $r_{y+2}$, $r_{y+3}$, $r_{y-3}$, $r_{y-4}$, etc., until all of the rows of the pixel array have been loaded. In other implementations, each block of two rows may be loaded "top-down" rather than inside-out. In such implementations, the rows of the pixel array 300 may be loaded according to the following sequence: $r_y$, $r_{y-2}$, $r_{y-1}$, $r_{y+2}$, $r_{y+3}$, $r_{y-4}$, $r_{y-3}$, etc. Although the block of rows loaded each iteration above or below the centrally located row $r_y$ includes two rows in the example of FIG. 3, in other implementations the block of rows may include more than two rows (e.g., 3 rows, 8 rows, 12 rows). In some implementations, the number of rows in each block may be variable. For example, a first number (e.g., two) of rows per block may be used near the central portion of the pixel array 300, and a second number (e.g., four) of rows per block may be used toward the top and bottom portions of the pixel array.

In at least some implementations of the present disclosure, a "speculative preload sequence" may be utilized to more rapidly load an image on a display by implementing a multiphase loading sequence which during a first phase loads a number of the rows with approximate or speculative values, and subsequently during a second phase loads the portion of the rows previously loaded with speculative preload data with their final or true values. Generally, the rows of a pixel array are divided into a number of spaced apart "direct load rows" and a number of "speculative preload rows" that are each associated with at least one nearby direct load row. As an example, in at least some implementations all of the even rows (e.g., rows $r_0$, $r_2$, $r_4$, $r_6$, . . . ) of a pixel array may be direct load rows and all of the odd rows (e.g., rows $r_1$, $r_3$, $r_5$, $r_7$, . . . ) may be speculative preload rows that are each associated with a respective previous even row (e.g., row $r_1$ associated with row $r_0$, row $r_3$ associated with row n, . . . ). As another example, every fourth row (e.g., row $r_0$, $r_4$, $r_8$, $r_{12}$ . . . ) may a direct load row and the three rows (e.g., rows $r_1$, $r_2$, $r_3$) following a direct load row (e.g., row $r_0$) may be speculative preload rows associated with the direct load row.

To implement the speculative preloading schemes discussed herein, the display system (e.g., display system 100) and/or the video source system (e.g., video source system 116) may be configured (e.g., hardware configured, programmatically configured) such that the loading of a direct load row with final image data for the direct load row simultaneously loads the one or more associated speculative preload rows with speculative preload data that is based at least in part on the final image data for the associated direct load row. For example, the display system and/or video source system may be configured such that the loading of a direct load row with final image data for the direct load row simultaneously loads the associated speculative preload rows with duplicates of the final image data for the direct load row. As another example, the display system and/or video source system may be configured such that the loading of a direct load row with final image data for the direct load row simultaneously loads the associated speculative preload rows with speculative preload image data that is at least one of extrapolated or interpolated from the final image data for a plurality of direct load rows (e.g., the associated direct load row and one or more nearby direct load rows).

In operation, the display system may implement a first loading phase, in which each of the direct load rows are sequentially loaded (e.g., top-to-bottom, bottom-to-top, inside-out (see FIGS. 2 and 3)) with final image data, which causes the associated speculative preload rows to be loaded with speculative preload data simultaneously with their respective direct load rows. Then, during a second loading phase, all of the speculative preload rows may be sequentially loaded (e.g., top-to-bottom, bottom-to-top, inside-out) with final image data.

Utilizing the speculative preloading sequences discussed herein advantageously loads the entire pixel array with approximately correct values in a fraction of the time required to load the pixel array using a conventional progressive scan. For example, if ½ of the rows are direct load rows, the entire pixel array is loaded with the approximately correct values in ½ the time required load the pixel array using a conventional progressive scan. Continuing with this example, the direct load rows would have a ½ of a frame duration to settle, whereas the speculative preload rows would have less time. However, the unsettled characteristics of the speculative preload rows would only be proportional to the difference between their final image data and the speculative preload data (e.g., duplicate of associated direct load row), which is much less than the difference between the prior frame of data.

Additionally, since the display system is configured to simultaneously load the speculative preload rows upon loading of their associated direct load row(s), the speculative preload sequences discussed herein do not add any additional bandwidth requirements compared to the conventional progressive load implementations.

FIG. 4A shows a pixel array 400 of a display system showing a first phase of a speculative preloading sequence for loading rows of pixels of the pixel array with image data. A table 402 shows the loading sequence for the first phase, and a table 404 show the data d that is loaded in rows of the pixel array 400 during the first phase. In the table 404, the subscript next to the data labels indicates the data is the final image data for the corresponding row (e.g., $d_x$ is the final image data for row $r_x$).

In this simplified example, the pixel array includes 16 rows, labeled rows $r_{0-15}$. The even rows (e.g., rows $r_0$, $r_2$, $r_4$, . . . ) are designated as direct load rows and the odd rows (e.g., rows $r_1$, $r_3$, $r_5$, . . . ) are designated as speculative preload rows that are each associated with a preceding even row (e.g., row $r_1$ is associated with row $r_0$). As discussed above, the display system (e.g., display system 100) and/or the video source system (e.g., video source system 116) may be configured such that the loading of a direct load row with final image data for the direct load row simultaneously loads the associated speculative preload rows with speculative preload data that is based at least in part on the final image data for the associated direct load row. In this example, loading of a direct load row causes its associated speculative preload row to be simultaneously loaded with the final image data for the direct load row. For example, loading of row $r_0$ with data $d_0$ causes the row $r_1$ to be simultaneously loaded with data $d_0$ for row $r_0$.

As shown in FIG. 4A, during the first loading phase, the even rows are sequentially loaded with their final image data in a top-down manner, beginning with row $r_0$ and ending with row $r_{14}$. As each even row is loaded, the odd row following the even row is simultaneously loaded with the same data that is loaded in the even row. Using this approach, the pixel array 400 is fully loaded with approximately the right values in ½ of the time required to load the pixel array using conventional progressive loading. Although the first loading phase is shown using a top-down sequence, in other implementations the first loading phase may utilize a bottom-up sequence (e.g., load row $r_{14}$, load row $r_{12}$, load row $r_{10}$, . . . ) or an inside-out sequence (see FIGS. 2 and 3). Further, in at least some implementations the odd rows may be selected as direct load rows and the even rows may be selected as speculative preload rows.

Figure 4B:
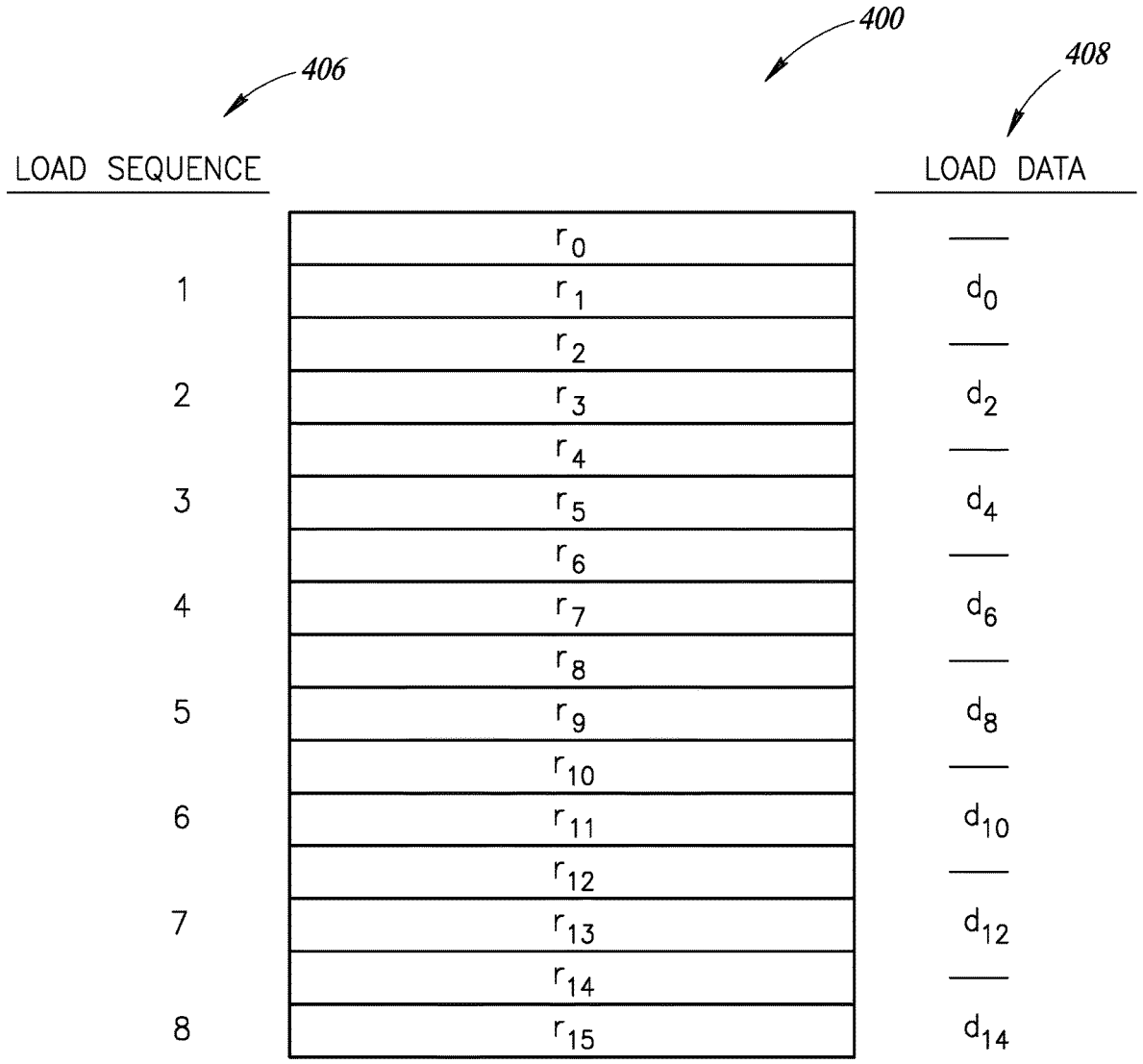
FIG. 4B is a diagram of the pixel array of FIG. 4B, showing a second phase of the speculative preloading sequence, according to one illustrated implementation.

FIG. 4B shows a second phase of the speculative preloading sequence that is executed subsequent to the first loading phase shown in FIG. 4A. A table 406 shows the loading sequence for the second phase, and a table 408 shows the data d that is loaded in the rows during the second phase. As discussed above, each of the even rows were loaded with final values during the first loading phase. During the second loading phase, each of the odd rows is loaded with their respective final values. Although the second loading phase is shown using a top-down sequence, in other implementations the second loading phase may utilize a bottom-up sequence (e.g., load row $r_{15}$, load row $r_{13}$, load row $r_{11}$, . . . ) or an inside-out sequence (see FIGS. 2 and 3).

FIG. 5A shows a pixel array 500 of a display system showing a first phase of a speculative preloading sequence for loading rows of pixels of the pixel array with image data, wherein the speculative preloading sequence operates on blocks of four rows rather than individual rows. A table 502 shows the loading sequence for the first phase, and a table 504 show the data d that is loaded in rows of the pixel array 500 during the first phase.

In this simplified example, the pixel array includes 16 rows, labeled rows $r_{0-15}$. Every fourth row (e.g., rows $r_0$, $r_4$, $r_5$, . . . ) is designated a direct load row and the three rows following each direct load row are designated as speculative preload rows associated with their preceding direct row (e.g., rows $r_{1-3}$ are associated with row $r_0$, rows $r_{5-7}$ are associated with row $r_4$). As discussed above, the display system (e.g., display system 100) and/or the video source system (e.g., video source system 116) may be configured such that the loading of a direct load row with final image data for the direct load row simultaneously loads the associated speculative preload rows with speculative preload data that is based on the final image data for the associated direct load row. In this example, loading of a direct load row causes its associated speculative preload rows to be simultaneously loaded with the final image data for the direct load row. For example, loading of row $r_0$ with data $d_0$ causes the rows $r_{1-3}$ to be simultaneously loaded with data $d_0$ for row $r_0$.

As shown in FIG. 5A, during the first loading phase, the direct load rows are sequentially loaded with their final image data in a top-down manner, beginning with row $r_0$ and continuing with rows $r_4$, $r_8$ and $r_{12}$. As each direct load row is loaded, the three speculative preload rows following the direct load row are simultaneously loaded with the same data that is loaded in the direct load row. Using this approach, the pixel array 500 is fully loaded with approximately correct values in ¼ of the time required to load the pixel array using conventional progressive loading. Although the first loading phase is shown using a top-down sequence, in other implementations the first loading phase may utilize a bottom-up sequence (e.g., load row $r_{12}$, load row $r_8$, load row $r_4$, load row $r_0$) or an inside-out sequence (see FIGS. 2 and 3).

FIG. 5B shows a second phase of the speculative preloading sequence that is executed subsequent to the first loading phase shown in FIG. 5A. A table 506 shows the loading sequence for the second phase, and a table 508 shows the data d that is loaded in the rows during the second phase. As discussed above, each of the direct load rows were loaded with final values during the first loading phase. During the second loading phase, each of the speculative preload rows is loaded with their respective final values. Although the second loading phase is shown using a top-down sequence, in other implementations the second loading phase may utilize a bottom-up sequence (e.g., load row $r_{15}$, load row $r_{13}$, load row $r_{11}$, . . . ) or an inside-out sequence (see FIGS. 2 and 3).

In the example of FIGS. 5A and 5B, each direct load row is associated with a block of three speculative preload rows. In other implementations, each direct load row may be associated with a block having fewer or more speculative preload rows. In some implementations, the number of rows in each block may be variable. For example, a first number (e.g., one, two) of rows per block may be used near the central portion of the pixel array 500, and a second number (e.g., three, eight) of rows per block may be used toward the top and bottom portions of the pixel array.

In at least some implementations, speculative preloading sequences may be provided which utilize more than two loading phases (e.g., three loading phases, eight loading phases). As an example, a display system may be configured to include rows that function as both direct load rows and speculative preload rows. As a non-limiting illustration, consider a simplified pixel array that includes eight rows labeled $r_{0-7}$. Rows $r_0$ and $r_4$ may be direct load rows, rows $r_2$ and $r_6$ may function as both direct load rows and speculative preload rows depending on the loading phase, and rows $r_1$, $r_3$, $r_5$ and $r_7$ may be speculative preload rows. The display system may be configured such that loading each of the rows $r_0$ and $r_4$ with final image data causes the three rows respectively below them (i.e., rows $r_{1-3}$ for row $r_0$ and rows $_{5-7}$ for row $r_4$) to be simultaneously loaded with speculative preload data, as discussed above. Rows $r_2$ and $r_6$ may function as both direct load rows and speculative preload rows, such that when the rows $r_2$ and $r_6$ are loaded with final image data, the rows immediately following them, rows $r_3$ and $r_7$, are simultaneously loaded with the final image data for rows $r_2$ and $r_6$, respectively.

In operation, during a first loading phase, row $r_0$ may be loaded with data $d_0$ for row $r_0$, which causes rows $r_{1-3}$ to be simultaneously loaded with the data $d_0$. Then, row $r_4$ may be loaded with data $d_4$ for row $r_4$, which causes rows $r_{5-7}$ to be simultaneously written with the data $d_4$. Thus, the pixel array may be loaded with approximately correct values in ¼ the time required to load the pixel array using a conventional progressive loading sequence.

During a second loading phase following the first loading phase, the row $r_2$ may be loaded with data $d_2$ for the row $r_2$, which causes row $r_3$ to be simultaneously written with the data $d_2$. Then, row $r_6$ may be loaded with data $d_6$ for row $r_6$, which causes row $r_7$ to be simultaneously written with the data $d_6$. Thus, after the second loading phase, the rows $r_0$, $r_2$, $r_4$ and $r_6$ are loaded with their final values and the rows $r_1$, $r_3$, $r_5$ and $r_7$ are loaded with speculative values based upon final values for adjacent rows.

Finally, during a third loading phase, the speculative preload rows $r_1$, $r_3$, $r_5$ and $r_7$ may be loaded with their final values.

FIG. 6A shows a pixel array 600 of a display system showing a first phase of an inside-out speculative preloading sequence for loading rows of pixels of the pixel array with image data. A table 602 shows the loading sequence for the first phase, and a table 604 show the data d that is loaded in rows of the pixel array 600 during the first phase.

In this simplified example, the pixel array includes 18 rows, labeled rows $r_{0-17}$. The even rows (e.g., rows $r_0$, $r_2$, $r_4$, . . . ) are designated as direct load rows and the odd rows (e.g., rows $r_1$, $r_3$, $r_5$, . . . ) are designated as speculative preload rows that are each associated with a preceding even row (e.g., row $r_1$ is associated with row $r_0$). As discussed above, the display system (e.g., display system 100) and/or the video source system (e.g., video source system 116) may be configured such that the loading of a direct load row with final image data for the direct load row simultaneously loads the associated speculative preload rows with speculative preload data that is based on the final image data for the associated direct load row. In this example, loading of a direct load row causes its associated speculative preload row to be simultaneously loaded with the final image data for the direct load row. For example, loading of row $r_0$ with data $d_0$ causes the row $r_1$ to be simultaneously loaded with data $d_0$ for row $r_0$.

As shown in FIG. 6A, during the first loading phase, the even rows are sequentially loaded with their final image data in an inside-out manner, beginning with row $r_8$ and alternating downward and upward to sequentially load rows $r_{10}$, $r_6$, $r_{12}$, $r_4$, $r_{14}$, $r_2$, $r_{16}$, and $r_0$. As each even row is loaded, the odd row following the even row is simultaneously loaded with the same data that is loaded in the even row, as discussed above. Using this approach, the pixel array 600 is fully loaded with approximately the right values in ½ of the time required to load the pixel array using conventional progressive loading, and the rows toward the middle of the pixel array are allowed to settle for a longer time period relative to the rows toward the top and bottom of the pixel array. In other implementations, the odd rows may be selected as direct load rows and the even rows may be selected as speculative preload rows.

Figure 6B:
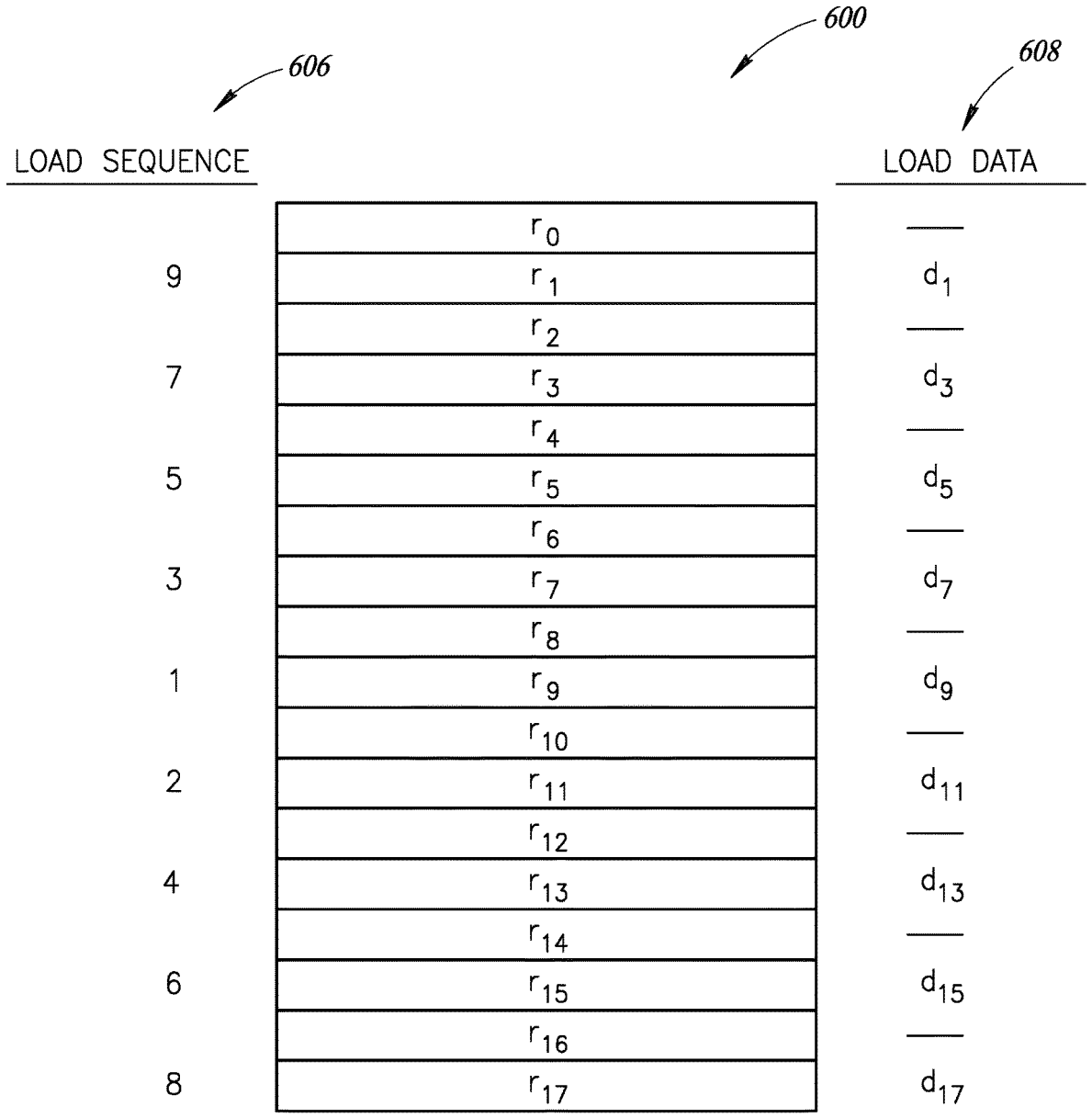
FIG. 6B is a diagram of the pixel array of FIG. 6B, showing a second phase of the inside-out speculative preloading sequence, according to one illustrated implementation.

FIG. 6B shows a second phase of the speculative preloading sequence that is executed subsequent to the first loading phase shown in FIG. 6A. A table 606 shows the loading sequence for the second phase, and a table 608 shows the data d that is loaded in the rows during the second phase. As discussed above, each of the even rows were loaded with final values during the first loading phase. During the second loading phase, each of the odd rows is loaded with their respective final values in an inside-out manner. That is, the odd rows are loaded according to the following order: row $r_9$, $r_{11}$ $r_7$, $r_{13}$, $r_5$, $r_{15}$, $r_3$, $r_{17}$, and $r_1$.

In the example of FIGS. 6A and 6B, each direct load row is associated with a single speculative preload row, but in other implementations each direct load row may be associated with block of multiple (e.g., two, three, eight) speculative preload rows. In some implementations, the number of rows in each block may be variable. For example, a first number (e.g., one, two) of rows per block may be used near the central portion of the pixel array 600, and a second number (e.g., three, eight) of rows per block may be used toward the top and bottom portions of the pixel array.

The foregoing detailed description has set forth various implementations of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one implementation, the present subject matter may be implemented via Application Specific Integrated Circuits (ASICs). However, those skilled in the art will recognize that the implementations disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

Those of skill in the art will recognize that many of the methods or algorithms set out herein may employ additional acts, may omit some acts, and/or may execute acts in a different order than specified.

In addition, those skilled in the art will appreciate that the mechanisms taught herein are capable of being distributed as a program product in a variety of forms, and that an illustrative implementation applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory.

The various implementations described above can be combined to provide further implementations. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A method of operating a display system, the display system comprising a pixel array that includes plurality of pixels arranged in rows and columns, the method comprising:

receiving, by at least one processor of the display system, an image stream comprising a plurality of sets of image data, each set of image data representative of an image to be sequentially presented by the pixel array of the display system, and each set of image data comprises a plurality of pixel values that each correspond to one of the plurality of pixels in the pixel array; and causing, by the at least one processor, each of the plurality of sets of image data to be sequentially loaded to the pixel array such that the images are sequentially presented by the pixel array, wherein causing each set of image data that is representative of an image to be loaded to the pixel array comprises, for each set of image data:

sequentially loading each of a plurality of direct load rows of the pixel array with final image data for each of the respective direct load rows, each of the direct load rows associated with a corresponding speculative preload row positioned proximate the direct load row, and simultaneously with the loading of each direct load row, loading the corresponding speculative preload row associated with the direct load row with speculative preload image data that is based on the final image data for the associated direct load row; and subsequent to sequentially loading each of the plurality of direct load rows, sequentially reloading each of the speculative preload rows of the pixel array with final image data for each of the respective speculative preload rows.

2. The method of claim 1 wherein the direct load rows comprise one of the even rows and the odd rows of the pixel array, and the speculative preload rows comprise the other of the even rows and the odd rows of the pixel array.

3. The method of claim 1 wherein loading the corresponding speculative preload row associated with the direct load row with speculative preload image data that is based on the final image data for the direct load row comprises loading the corresponding speculative preload row associated with the direct load row with speculative preload image data that is a duplicate of the final image data for the associated direct load row.

4. The method of claim 1 wherein loading the corresponding speculative preload row associated with the direct load row with speculative preload image data that is based on the final image data for the direct load row comprises loading the corresponding speculative preload row associated with the direct load row with speculative preload image data that is at least one of extrapolated or interpolated from the final image data for a plurality of direct load rows.

5. The method of claim 1 wherein sequentially loading each of a plurality of direct load rows comprises sequentially loading each of a plurality of direct load rows beginning at a top direct load block that includes a top row of the pixel array and proceeding downward toward a bottom row of the pixel array.

6. The method of claim 5 wherein sequentially loading each of the speculative preload rows comprises sequentially loading each of the speculative preload rows beginning at a speculative preload row included in the top direct load block of the pixel array and proceeding downward toward the bottom row of the pixel array.

7. A display system, comprising:

a pixel array that includes plurality of pixels arranged in rows and columns;

at least one pixel driver subsystem operatively coupled to the pixel array; and at least one processor operatively coupled to the at least one pixel driver subsystem, in operation the at least one processor:

receives an image stream comprising a plurality of sets of image data, each set of image data representative of an image to be sequentially presented by the pixel array of the display system, and each set of image data comprises a plurality of pixel values that each correspond to one of the plurality of pixels in the pixel array; and causes the at least one pixel driver subsystem to sequentially load each of the plurality of sets of image data to the pixel array such that the images are sequentially presented by the pixel array, wherein, for each set of image data, the at least one processor causes the at least one pixel driver subsystem to:

sequentially load each of a plurality of direct load rows of the pixel array with final image data for each of the respective direct load rows, each of the direct load rows associated with a corresponding speculative preload row positioned proximate the direct load row, and simultaneously with the loading of each direct load row, loading the corresponding speculative preload row associated with the direct load row with speculative preload image data that is based on the final image data for the associated direct load row; and subsequent to the sequential load each of the plurality of direct load rows, sequentially reload each of the speculative preload rows of the pixel array with final image data for each of the respective speculative preload rows.

8. The display system of claim 7 wherein the direct load rows comprise one of the even rows and the odd rows of the pixel array, and the speculative preload rows comprise the other of the even rows and the odd rows of the pixel array.

9. The display system of claim 7 wherein the at least one processor causes the at least one pixel driver subsystem to load the corresponding speculative preload row associated with the direct load row with speculative preload image data that is a duplicate of the final image data for the associated direct load row.

10. The display system of claim 7 wherein the at least one processor causes the at least one pixel driver subsystem to load the corresponding speculative preload row associated with the direct load row with speculative preload image data that is at least one of extrapolated or interpolated from the final image data for a plurality of direct load rows.

11. The display system of claim 7 wherein the at least one processor causes the at least one pixel driver subsystem to load each of a plurality of direct load rows beginning at a top direct load block that includes a top row of the pixel array and proceeding downward toward a bottom row of the pixel array.

12. The display system of claim 11 wherein the at least one processor causes the at least one pixel driver subsystem to sequentially load each of the speculative preload rows beginning at a speculative preload row included in the top direct load block of the pixel array and proceeding downward toward the bottom row of the pixel array.

13. A method of operating a video source system that in operation provides image data to a display system, the display system comprising a pixel array that includes plurality of pixels arranged in rows and columns, the method comprising:

sending, by at least one processor, an image stream comprising a plurality of sets of image data to the display system, each set of image data representative of an image to be sequentially presented by the pixel array of the display system, and each set of image data comprises a plurality of pixel values that each correspond to one of the plurality of pixels in the pixel array wherein sending the image stream comprises, for each set of image data:

sequentially sending final image data for each of a plurality of direct load rows of the pixel array to the display system for loading by the display system, each of the direct load rows associated with a corresponding speculative preload row positioned proximate the direct load row, wherein simultaneously with the loading of each direct load row by the display system, the display system loads the corresponding speculative preload row associated with the direct load row with speculative preload image data that is based on the final image data for the associated direct load row; and subsequent to sequentially sending final image data for each of the plurality of direct load rows, sequentially sending final image data for each of the speculative preload rows of the pixel array to the display system for loading by the display system.

14. The method of claim 13 wherein the direct load rows comprise one of the even rows and the odd rows of the pixel array, and the speculative preload rows comprise the other of the even rows and the odd rows of the pixel array.

15. The method of claim 13 wherein loading the corresponding speculative preload row associated with the direct load row with speculative preload image data that is based on the final image data for the direct load row comprises loading the corresponding speculative preload row associated with the direct load row with speculative preload image data that is a duplicate of the final image data for the associated direct load row.

16. The method of claim 13 wherein loading the corresponding speculative preload row associated with the direct load row with speculative preload image data that is based on the final image data for the direct load row comprises loading the corresponding speculative preload row associated with the direct load row with speculative preload image data that is at least one of extrapolated or interpolated from the final image data for a plurality of direct load rows.

17. The method of claim 13 wherein sequentially loading each of a plurality of direct load rows comprises sequentially loading each of a plurality of direct load rows beginning at a top direct load block that includes a top row of the pixel array and proceeding downward toward a bottom row of the pixel array.

18. The method of claim 17 wherein sequentially loading each of the speculative preload rows comprises sequentially loading each of the speculative preload rows beginning at a speculative preload row included in the top direct load block of the pixel array and proceeding downward toward the bottom row of the pixel array.

19. A video source system, comprising:

at least one nontransitory processor-readable storage medium which stores at least one of instructions or data;

at least one processor operatively coupled to the at least one nontransitory processor-readable storage medium and a display system, the display system comprising a pixel array that includes a plurality of pixels arranged in rows and columns, in operation the at least one processor:

sends an image stream comprising a plurality of sets of image data to the display system, each set of image data representative of an image to be sequentially presented by the pixel array of the display system, and each set of image data comprises a plurality of pixel values that each correspond to one of the plurality of pixels in the pixel array, wherein for each set of image data, in operation the processor:

sequentially sends final image data for each of a plurality of direct load rows of the pixel array to the display system for loading by the display system, each of the direct load rows associated with a corresponding speculative preload row positioned proximate the direct load row, wherein simultaneously with the loading of each direct load row by the display system, the display system loads the corresponding speculative preload row associated with the direct load row with speculative preload image data that is based on the final image data for the associated direct load row; and subsequent to final image data for each of the plurality of direct load rows being sequentially sent, sequentially sends final image data for each of the speculative preload rows of the pixel array to the display system for loading by the display system.

20. The video source system of claim 19 wherein the direct load rows comprise one of the even rows and the odd rows of the pixel array, and the speculative preload rows comprise the other of the even rows and the odd rows of the pixel array.

21. The video source system of claim 19 wherein the at least one processor causes the display system to load the corresponding speculative preload row associated with the direct load row with speculative preload image data that is a duplicate of the final image data for the associated direct load row.

22. The video source system of claim 19 wherein the at least one processor causes the display system to load the corresponding speculative preload row associated with the direct load row with speculative preload image data that is at least one of extrapolated or interpolated from the final image data for a plurality of direct load rows.

23. The video source system of claim 19 wherein the at least one processor causes the display system to load each of a plurality of direct load rows beginning at a top direct load block that includes a top row of the pixel array and proceeding downward toward a bottom row of the pixel array.

24. The video source system of claim 23 wherein the at least one processor causes the display system to sequentially load each of the speculative preload rows beginning at a speculative preload row included in the top direct load block of the pixel array and proceeding downward toward the bottom row of the pixel array.

* * * * *